US005706844A

United States Patent [19]

Lin et al.

[11] Patent Number: 5,706,844

[45] Date of Patent: Jan. 13, 1998

[54] POCKETABLE FOLDING UMBRELLA

[75] Inventors: Chung-Kuang Lin; Jung-Jen Chang, both of Taipei Hsien, Taiwan

[73] Assignee: Fu Tai Umbrella Works, Ltd., Taipei Hsien, Taiwan

[21] Appl. No.: 600,070

[22] Filed: Feb. 12, 1996

Related U.S. Application Data

[63] Continuation-in-part of Ser. No. 439,509, May 11, 1995.

[51] Int. Cl.[6] ..... A45B 19/00

[52] U.S. Cl. ..... 135/25.1; 135/25.4; 135/28

[58] Field of Search ..... 135/20.1, 25.1, 135/25.4, 28, 38, 41

[56] References Cited

U.S. PATENT DOCUMENTS

| | | | |
|---|---|---|---|
| 1,208,097 | 12/1916 | Collins et al. | 135/20.1 X |
| 1,824,192 | 9/1931 | Bouma | 135/28 X |
| 2,635,616 | 4/1953 | Haydu | 135/28 |
| 2,796,073 | 6/1957 | Wittman | 135/28 |
| 3,837,352 | 9/1974 | Weber | 135/20.1 X |
| 4,474,201 | 10/1984 | Kida | 135/20.1 X |
| 5,355,903 | 10/1994 | Haddad et al. | 135/20.1 |

*Primary Examiner*—Lanna Mai

[57] ABSTRACT

A pocketable folding umbrella includes: a slim upper notch secured on an upper portion of a central shaft; a slim lower runner slidably held on the central shaft; a plurality of extremity rib sets respectively radially pivotally secured to two extremity portions of the upper notch and the lower runner, a plurality of flat-side rib sets respectively universally pivotally secured to an upper gradational platform protruding downwardly from the upper notch and a lower gradational platform protruding upwardly from the lower runner, and an umbrella cloth secured with the rib sets, whereby upon folding of the umbrella from an opened state, the flat-side rib sets will be inwardly folded from an outer biased position towards a flat side portion of the upper gradational platform of the upper notch and towards a flat side portion of the lower gradational platform of the lower runner as accompanied with a radially folding of the extremity rib sets on the two extremity portions of the upper notch and the lower runner for greatly minimizing the dimensions of the upper notch and the lower runner for reducing the volume of the folded umbrella for a convenient carrying and storage when stored in a pocket or a handbag.

3 Claims, 5 Drawing Sheets

POCKETABLE FOLDING UMBRELLA

BACKGROUND OF THE INVENTION

This invention is a continuation-in-part of U.S. Patent Application filed by the same inventors on: May 11, 1995 with a Ser. No. of: 08/439,509, including a slim upper notch secured on an upper portion of a central shaft, a slim lower runner slidably held on the central shaft, a plurality of extremity rib sets respectively radially pivotally secured to two extremity portions of the upper notch and the lower runner, a plurality of flat-side rib sets respectively universally pivotally secured to the two flat-side portions of the upper notch and the lower runner, and an umbrella cloth secured with the rib sets.

However, the upper notch 3 should be formed with a plurality of cavities 35 and the lower runner 4 formed with cutouts 45 in order for receiving the ribs into the upper cavities 35 and the lower cutouts 45 when folded. Such cavities 35 and cutouts 45 will occupy a considerable length and width of the upper notch 3 and the lower runner 4, thereby influencing the volume of a folded umbrella.

The present inventors have found the drawbacks of the original application and invented the present pocketable folding umbrella having gradational platforms respectively formed on the upper notch and the lower runner for pivoting the flat-side ribs on the gradational platforms for eliminating the upper cavities and lower cutouts as formed in the original application.

SUMMARY OF THE INVENTION

The object of the present invention is to provide a pocketable folding umbrella including a slim upper notch secured on an upper portion of a central shaft; a slim lower runner slidably held on the central shaft; a plurality of extremity rib sets respectively radially pivotally secured to two extremity portions of the upper notch and the lower runner, a plurality of flat-side rib sets respectively universally pivotally secured to an upper gradational platform protruding downwardly from the upper notch and a lower gradational platform protruding upwardly from the lower runner, and an umbrella cloth secured with the rib sets, whereby upon folding of the umbrella from an opened state, the flat-side rib sets will be inwardly folded from an outer biased position towards a flat side portion of the upper gradational platform of the upper notch and towards a flat side portion of the lower gradational platform of the lower runner as accompanied with a radially folding of the extremity rib sets on the two extremity portions of the upper notch and the lower runner for greatly minimizing the dimensions of the upper notch and the lower runner for reducing the volume of the folded umbrella for a convenient carrying and storage when stored in a pocket or a handbag.

DETAILED DESCRIPTION

Figure 5:
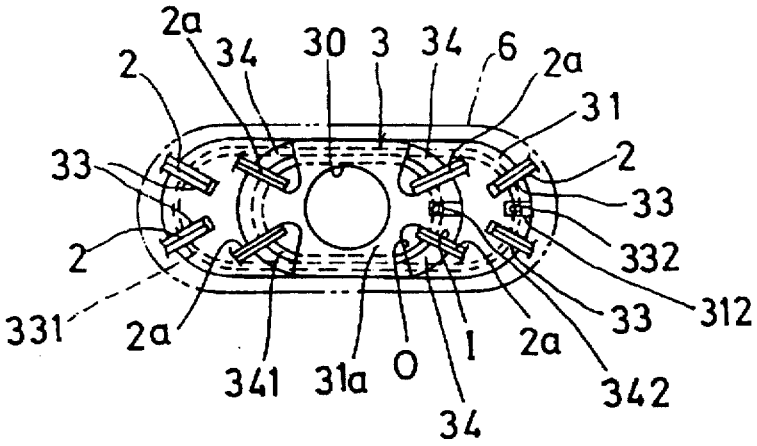
FIG. 5 is a bottom view of the upper notch when closed and packaged.
Figure 6:
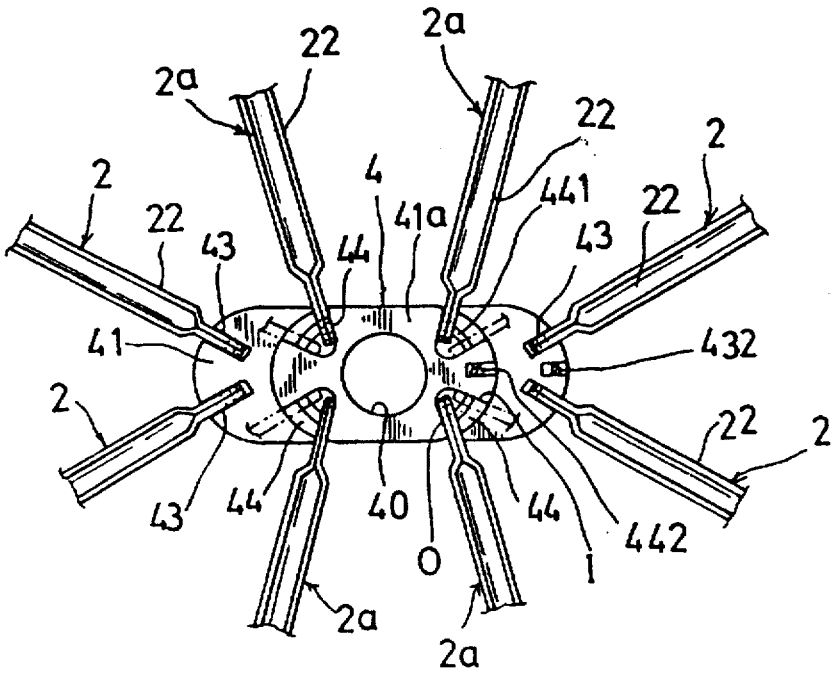
FIG. 6 is a top view of the lower runner when opening the umbrella of the present invention.

As shown in FIGS. 1–6, the present invention comprises: a telescopic central shaft 1 having a grip 12 formed on a lower portion of the shaft 1; a rib assembly consisting of a plurality of extremity rib means 2 and a plurality of flat-side rib means **2*a*; a slim upper notch 3 secured on an upper portion 11 of the central shaft 1; a slim lower runner 4 slidably held on the central shaft 1 and positioned below the upper notch 3; an umbrella cloth 5 secured on the rib means 2, 2*a* and divided into a plurality of sectors 50 each sector 50 radially secured with two neighboring rib means with joints 51; and a packaging 6 for storing a folded umbrella of the present invention as shown in FIG. 5. The grip 12 is downwardly recessed with a socket 121 therein for receiving partial lower runner 4** when folding the umbrella.

Each extremity rib means 2 includes: at least a top rib 21 having an inner end portion 211 of the top rib 21 radially pivotally secured to a pivoting means 33 formed at each extremity portion E of the upper notch 3, and at least a stretcher rib 22 having an inner end portion 221 of the stretcher rib 22 radially pivotally secured to a pivoting means 43 formed at each extremity E of the lower runner 4 with the stretcher rib 22 pivotally connected with the top rib 21. Other ribs may be pivotally connected with the top rib 21 and the stretcher rib 22 as shown in the figures, not limited in this invention.

Each flat-side rib means **2*a* includes: at least a top rib 21 having an inner end portion 211 of the top rib 21 universally pivotally secured to a biasing means 34 formed on an upper gradational platform 31*a* of the upper notch 3 adjacent to a flat side portion S of the upper notch 3, and at least a stretcher rib 22 having an inner end portion 221 of the stretcher rib 22 universally pivotally secured to a biasing means 44 formed on a lower gradational platform 41*a* of the lower runner 4 adjacent to a flat side portion S of the lower runner 4 with the stretcher rib 22 pivotally connected with the top rib 21. Other ribs may be further provided for pivotally connecting the top rib 21 and the stretcher rib 22**.

The slim upper notch 3 includes: an upper slim plate 31 generally elliptic or rectangular shaped defining a long axis X between two extremity portions E disposed on two opposite ends of the slim plate 31 and a short axis Y between two flat side portions S of the slim plate 31 and perpendicular to the long axis X, a central recess 30 recessed in a central portion of the slim plate 31 engaged with an upper portion 11 of the central shaft 1 for securing the upper notch 3 on the upper portion 11 of the central shaft 1, a plurality of pivoting means 33 formed on two opposite extremity portions E of the slim plate 31 for radially pivotally securing a plurality of top ribs 21 of the extremity rib means 2 about a pivoting wire 331 wound in a wire groove 311 circumferentially formed in the upper slim plate 31, a plurality of biasing means 34 contiguous to the two opposite flat side portions S of the upper notch 3 and formed on the upper gradational platform **31*a* which is protruded downwardly from the upper slim plate 31 and having a cross sectional area of the upper gradational platform 31***a* smaller than that of the upper slim plate 31, each biasing means 34 having a guiding wire 341 wound in a wire groove 311*a* circumferentially formed in the upper gradational platform 31*a* for universally pivotally securing a plurality of top ribs 21 of the flat-side rib means 2*a*, and the pivoting wire 331 having its knot 332 tied and fastened in a knot socket 312 recessed in the upper plate 31.

Each biasing means 34 is formed with an inside retarding portion I on the upper gradational platform 31*a* to be generally parallel to the long axis X for resting an inner portion of a top rib 21 of a folded flat-side rib means 2*a*, and an outside retarding portion 0 deviating from the inside retarding portion I with an acute angle to be generally parallel to the short axis Y and contiguous to the flat side portion S of the upper notch 3 for stopping the inner portion of the top rib 21 of an opened flat-side rib means 2*a*.

The guiding wire 341 of the biasing means 34 is pivotally engaged with an inner end portion 211 of the top rib 21 for circularly guiding the top rib 21 outwardly when opening the umbrella as pulled by the extremity rib means 2 and the umbrella cloth 5, and also for circularly guiding the top rib 21 inwardly for retracting the rib means 2*a* when folding the umbrella for storing the rib means 2*a* on the upper gradational platform 31*a* of the upper notch 3. The guiding wire 341 has its knot 342 tied and fastened in a knot socket 312*a* recessed in the upper platform 31*a*.

The slim lower runner 4 includes: a lower slim plate 41 generally elliptic or rectangular shaped defining a long axis X between two extremity portions E disposed on two opposite ends of the lower slim plate 41 and a short axis Y between two flat side portions S of the lower slim plate 41 and perpendicular to the long axis X, a sleeve portion 42 perpendicularly secured with the lower slim plate 41 having a central hole 40 formed through the sleeve portion 42 slidably held on the central shaft 1, a plurality of pivoting means 43 formed on two opposite extremity portions E of the lower slim plate 41 for radially pivotally securing a plurality of stretcher ribs 22 of the extremity rib means 2 about a pivoting wire 431 wound in a wire groove 411 circumferentially formed in the lower slim plate 41, a plurality of biasing means 44 contiguous to two opposite flat side portions S of the lower runner 4 and formed on the lower gradational platform 41*a* which is protruded upwardly from the lower slim plate 41 and having a cross sectional area of the lower gradational platform smaller than that of the lower slim plate 41, each biasing means 44 having a guiding wire 441 wound in a wire groove 411*a* circumferentially formed in the lower gradational platform 41*a* for universally pivotally securing a plurality of stretcher ribs 22 of the flat-side rib means 2*a*, and the pivoting wire 431 has its wire knot 432 tied and fastened in a knot socket 412 recessed in the lower plate 41.

Each biasing means 44 of the lower runner 4 is formed with an inside retarding portion I on the lower gradational platform 41*a* to be generally parallel to the long axis X for resting an inner portion of a stretcher rib 22 of a folded flat-side rib means 2*a*, and an outside retarding portion O deviating from the inside retarding portion I with an acute angle to be generally parallel to the short axis Y and contiguous to the flat side portion S of the lower runner 4 for stopping the inner portion of the stretcher rib 22 of an opened flat-side rib means 2*a*.

The guiding wire 441 of the biasing means 44 of the lower runner 4 is pivotally engaged with an inner end portion 221 of the stretcher rib 22 for circularly guiding the stretcher rib 22 outwardly when opening the umbrella as pulled by the extremity rib means 2 and the umbrella cloth 5, and also for circularly guiding the stretcher rib 22 inwardly for retracting the rib means 2*a* when folding the umbrella for storing the rib means 2*a* on the lower gradational platform 41*a* of the lower runner 4. The guiding wire 441 has its knot 442 tied and fastened in a knot socket 412*a* recessed in the lower platform 41*a*.

The sleeve portion 42 of the lower runner 4 includes a pair of flat portions 422 disposed on two opposite ends of a flange 421 formed on a lower periphery of the lower runner 4 to be snugly received in the socket 121 of the grip 12 when folding the umbrella.

Figure 1:
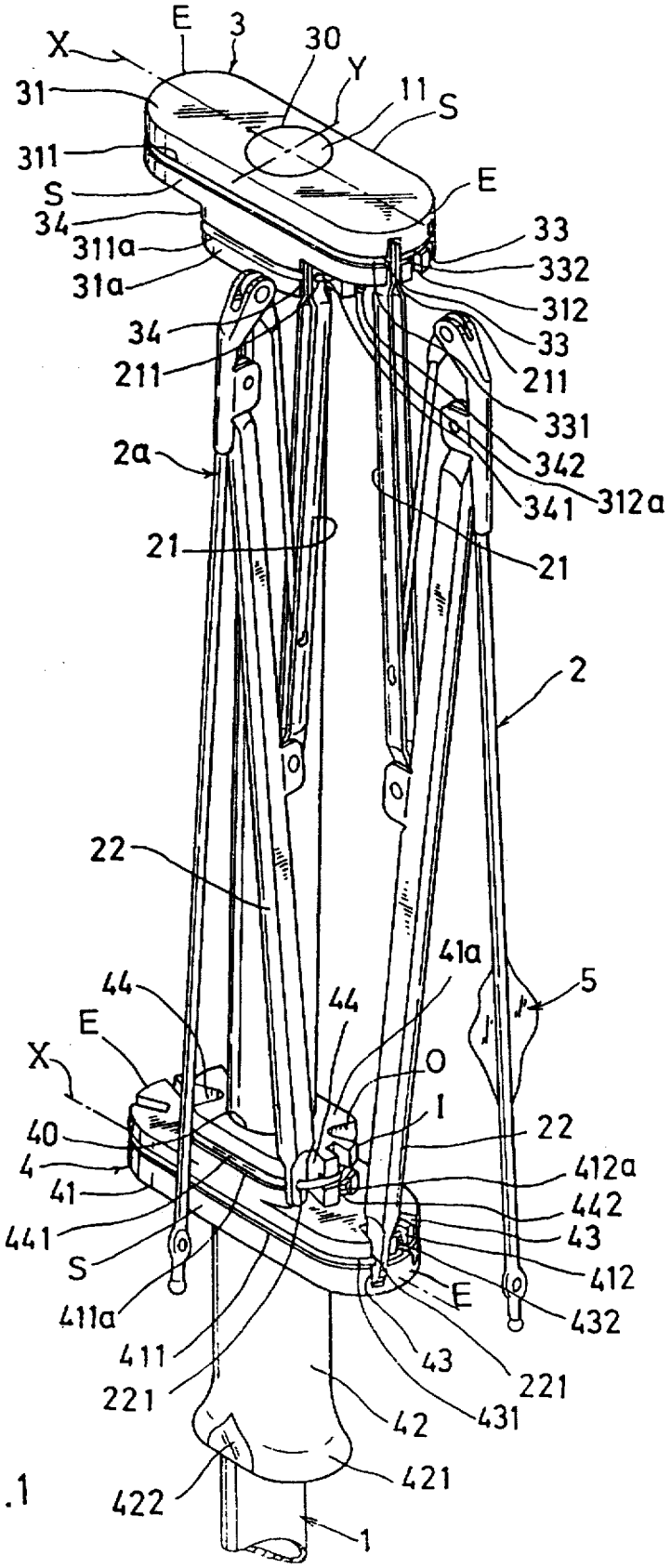
FIG. 1 is a perspective view of the present invention showing an umbrella initiated for opening from a folded state.
Figure 2:
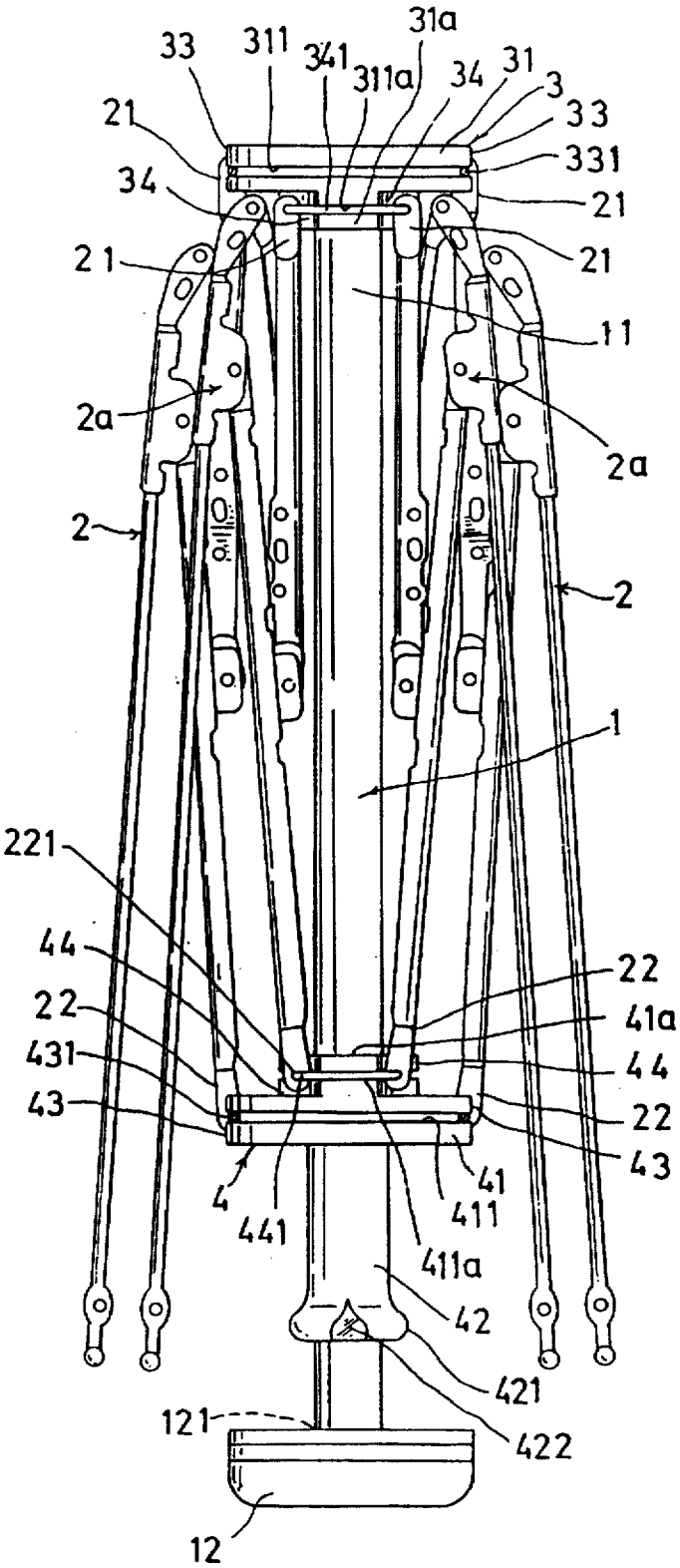
FIG. 2 is a front view of a folded umbrella of the present invention.
Figure 3:
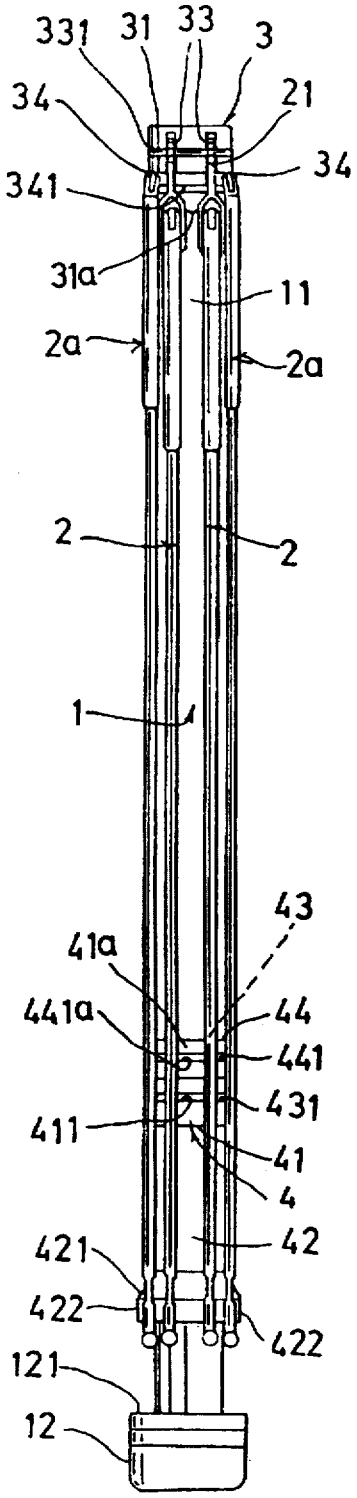
FIG. 3 is a side view of the folded umbrella from a right-side view of FIG. 2.
Figure 4:
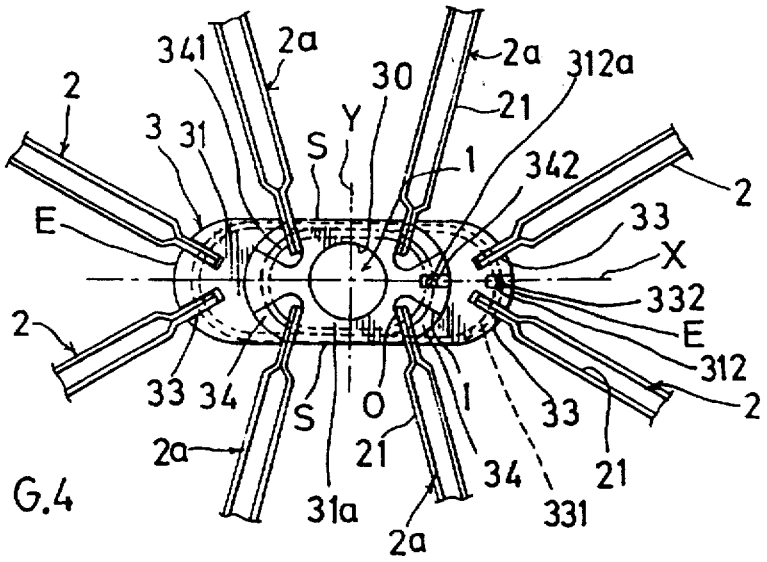
FIG. 4 is a bottom view of the upper notch of the present invention when opened.
Figure 4A:
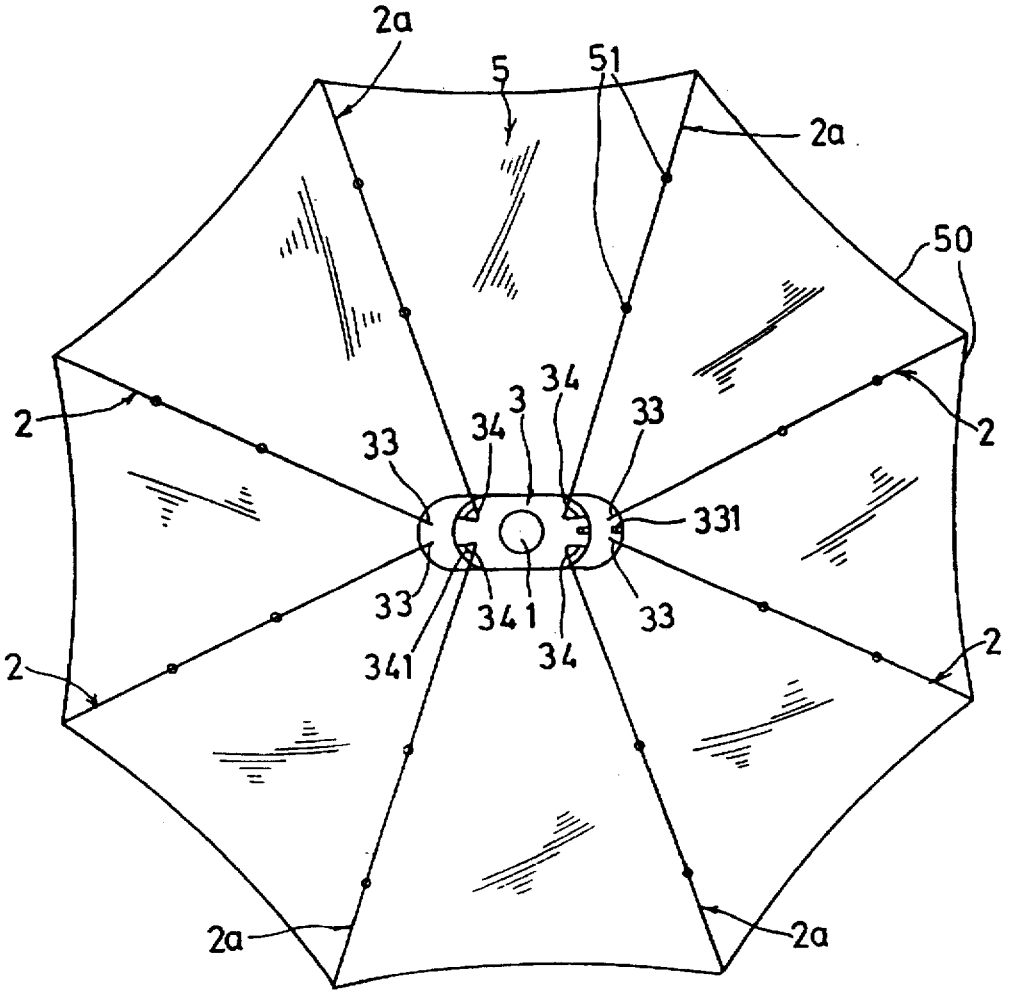
FIG. 4A is an illustration showing an opened umbrella indicating the relationship of the cloth and the ribs.

When opening the umbrella of the present invention from a closed state, one hand of the user may lower the grip 12 while his another hand may raise the lower runner 4 to radially unfold the extremity rib means 2 and to open the umbrella cloth 5. Since the flat-side rib means 2*a* and the extremity rib means 2 are generally homogeneously distributed on the umbrella cloth 5 to form a plurality of sectors 50, the opening umbrella cloth 5 as upwardly radially pulled by the extremity rib means 2 will be tensioned so as to simultaneously bias all the flat-side rib means 2*a* to be radially opened and to unfold the flat-side rib means 2*a* upwardly radially as universally or circularly biased by the biasing means 44, 34 on the lower runner 4 and the upper notch 3 for stably opening the umbrella as shown in FIG. 4A.

Upon folding of the umbrella from its opened state, the extremity rib means 2 will be radially folded and the flat-side rib means 2*a* will be folded on the upper gradational platform 31*a* and the lower gradational platform 41*a* formed in the upper notch 3 and the lower runner 4 to greatly minimize a folding volume even smaller than that of the original application U.S. Ser. No. 08/439,509 for a convenient handling and storage especially for an easy storage in a handbag or jacket pocket when packed into a packaging 6. Accordingly, the cavities 35 and the cutouts 45 as formed in the original application can be eliminated to further decrease the volume of the upper notch 3 and the lower runner 4.

Figure 7:
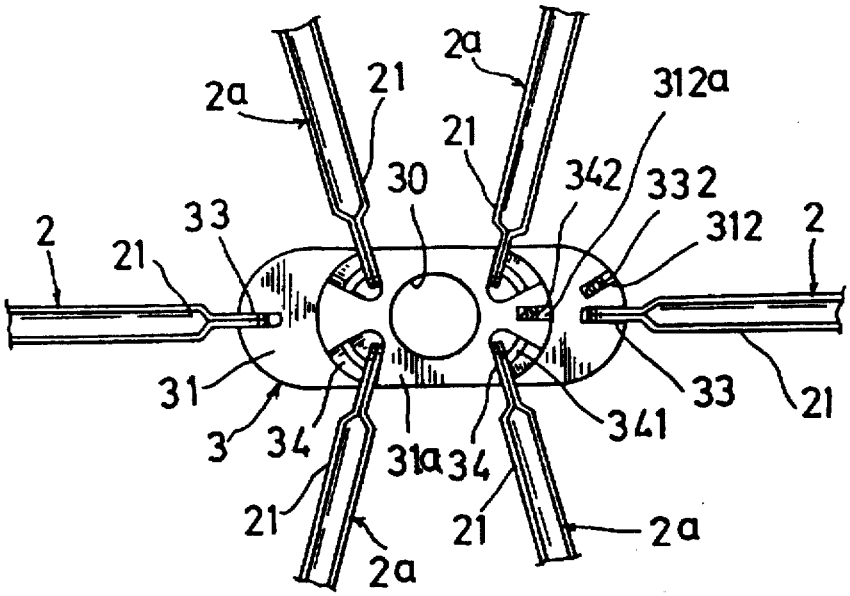
FIG. 7 is a bottom view of the upper notch of another preferred embodiment of the present invention when opened.
Figure 8:
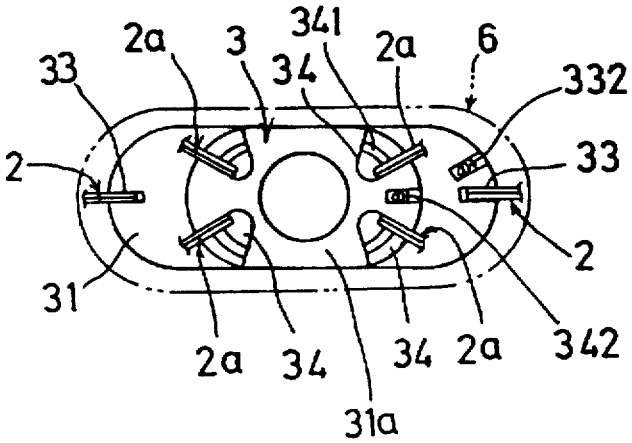
FIG. 8 is a bottom view of a folded umbrella of the present invention following FIG. 7.

Another preferred embodiment of the present invention is shown in FIGS. 7, 8, which includes six sets of rib means 2, 2*a* as modified from the eight sets rib means as aforementioned. The number of sets of the rib means 2, 2*a* are not limited in this invention.

The present invention may be modified without departing from the spirit and scope of the present invention.

We claim:

1. A folding umbrella comprising:

a telescopic central shaft (1);

a slim upper notch (3) formed as a generally rectangular shape defining two opposite extremity portions on a long axis (X) and two opposite flat-side portions on a short axis (Y) perpendicular to the long axis (X), and secured on an upper portion of said central shaft (1);

a slim lower runner (4) formed as a generally rectangular shape defining two opposite extremity portions on a long axis (X) and two opposite flat-side portions on a short axis (Y) perpendicular to the long axis (X), and slidably held on said central shaft (1);

a plurality of extremity rib means (2) disposed on two opposite extremity portions of said upper notch (3) and said lower runner (4), each said extremity rib means (2) having at least a top rib (21) and a stretcher rib (22) pivotally connected with said top rib (21), said top rib (21) and stretcher rib (22) radially pivotally secured to said upper notch (3) and said lower runner (4);

a plurality of flat-side rib means (2*a*) disposed on two opposite flat side portions of said upper notch (3) and said lower runner (4), each said flat-side rib means (2*a*) having at least a top rib (21) and a stretcher rib (22) pivotally connected with said top rib (21), said top rib (21) and said stretcher rib (22) on said flat-side rib means (2*a*) universally pivotally secured to each said flat-side portion of said upper notch (3) and said lower runner (4); and an umbrella cloth (5) radially secured with said plurality of extremity rib means (2) and said flat-side rib means (2*a*) on said cloth (5) having a plurality of sectors (50) divided on said cloth (5) with each said sector (50) defined between every two neighboring rib means (2, 2*a*);

whereby upon unfolding of said rib means (2, 2*a*) of the umbrella, each said extremity rib means (2) is radially extended for pulling said umbrella cloth (5) and said flat-side rib means (2*a*) for outwardly biasing said flat-side rib means (2*a*) for opening the umbrella; and upon folding of the rib means (2, 2*a*), each said flat-side rib means (2*a*) is retracted to each said flat side portion of said upper notch (3) and said lower runner (4) for minimizing a folding volume;

said slim upper notch (3) including: an upper slim plate (31) generally rectangular shaped defining said long axis (X) between two extremity portions (E) disposed on two opposite ends of the slim plate (31) and said short axis (Y) between two flat side portions (S) of the slim plate (31) and perpendicular to the long axis (X), a plurality of pivoting means (33) formed on two opposite extremity portions (E) of the slim plate (31) for radially pivotally securing a plurality of said top ribs (21) of the extremity rib means (2) about a pivoting wire (331) circumferentially wound on said upper slim plate (31), a plurality of biasing means (34) contiguous to two opposite flat side portions (S) of the upper notch (S) and formed on an upper gradational platform (31*a*) which is protruded downwardly from the upper slim plate (31), and said upper gradational platform (31*a*) having a cross sectional area smaller than that of the upper slim plate (31) for universally pivotally securing a plurality of said top ribs (21) of the flat-side rib means (2*a*) about a guiding wire (341) circumferentially wound on said upper gradational platform (31*a*); and said slim lower runner (4) including: a lower slim plate (41) generally rectangular shaped defining said long axis (X) between two extremity portions (E) disposed on two opposite ends of the lower slim plate (41) and said short axis (Y) between two flat side portions (S) of the lower slim plate (41) and perpendicular to the long axis (X), a plurality of pivoting means (43) formed on two opposite extremity portions (E) of the lower slim plate (41) for radially pivotally securing a plurality of said stretcher ribs (22) of the extremity rib means (2) about a pivoting wire (431) wound in the lower slim plate (41), a plurality of biasing means (44) contiguous to two opposite flat side portions (S) of the lower runner (4) and formed on a lower gradational platform (41*a*) which is protruded upwardly from the lower slim plate (41), and said lower gradational platform (41*a*) having a cross sectional area smaller than that of the lower slim plate (41) for universally pivotally securing a plurality of said stretcher ribs (22) of the flat-side rib means (2*a*) about a guiding wire (441) circumferentially wound on said lower gradational platform (41*a*).

2. A folding umbrella according to claim 1, wherein each said biasing means (34) of the upper notch (3) is formed with an inside retarding portion (I) on said upper gradational platform (31*a*) to be generally parallel to the long axis (X) for resting an inner portion of a top rib (21) of a folded flat-side rib means (2*a*), and an outside retarding portion (O) deviating from the inside retarding portion (I) with an acute angle to be generally parallel to the short axis (Y) and contiguous to the flat side portion (S) of the upper notch (3) for stopping the inner portion of the top rib (21) of an opened flat-side rib means (2*a*).

3. A folding umbrella according to claim 1, wherein each said biasing means (44) of the lower runner (4) is formed with an inside retarding portion (I) on said lower gradational platform (41*a*) to be generally parallel to the long axis (X) for resting an inner portion of a stretcher rib (22) of a folded flat-side rib means (2*a*), and an outside retarding portion (O) deviating from the inside retarding portion (I) with an acute angle to be generally parallel to the short axis (Y) and contiguous to the flat side portion (S) of the lower runner (4) for stopping the inner portion of the stretcher rib (22) of an opened flat-side rib means (2*a*).

* * * * *